United States Patent [19]

Wing

[11] Patent Number: 4,549,535

[45] Date of Patent: Oct. 29, 1985

[54] LINEAR MOTOR MASSAGE APPARATUS

[76] Inventor: Thomas W. Wing, 900 E. Holt Ave., Pomona, Calif. 91767

[21] Appl. No.: 447,151

[22] Filed: Dec. 6, 1982

[51] Int. Cl.[4] ..... A61H 7/00; A61H 23/00

[52] U.S. Cl. ..... 128/55; 128/52; 128/41; 310/35

[58] Field of Search ..... 128/51-55, 128/24.2, 41, 43, 44, 46; 310/24, 35

[56] References Cited

U.S. PATENT DOCUMENTS

| | | | |
|---|---|---|---|
| 1,098,893 | 6/1914 | Dinsmoor | 310/35 |
| 1,120,414 | 12/1914 | Schoolfield | 310/35 |
| 1,796,444 | 6/1926 | Dell'Era et al. | 128/55 |
| 2,154,427 | 10/1935 | Andres | 128/55 |
| 2,837,084 | 6/1958 | Brumek | 128/41 |
| 3,096,758 | 7/1963 | Savage | 128/41 |
| 4,016,873 | 4/1977 | Anderson | 128/54 |
| 4,069,816 | 1/1978 | Yamamura et al. | 128/41 |
| 4,088,128 | 5/1978 | Mabuchi | 128/52 |
| 4,265,228 | 5/1981 | Zoll | 128/55 |

FOREIGN PATENT DOCUMENTS

| | | | |
|---|---|---|---|
| 1548917 | 7/1979 | United Kingdom | 128/55 |

*Primary Examiner*—Richard J. Apley
*Assistant Examiner*—S. R. Crow
*Attorney, Agent, or Firm*—Gene W. Arant; Paul H. Ware

[57] ABSTRACT

A linear motor apparatus capable of delivery of single or multiple impacts to the body so as to provide massage or other treatment. Frequency, duration and force of impact are operator controlled variables. Resonances may be set up in body tissue material so as to result in standing waves in said body material.

3 Claims, 5 Drawing Figures

LINEAR MOTOR MASSAGE APPARATUS

BACKGROUND OF THE INVENTION

This invention relates to physical treatment of human beings by vibration, massage, and the application of mechanical impulses. A linear motor is used to cause the striking of an anvil carrying a rubber tip or the like. The motor has an armature that is driven back and forth by the successive alternate application of electric power to two solenoid coils. A first application of electric power to a first coil causes a striking of the anvil by the main shaft impact tip while a second application of power to a second coil effects the retraction of the main shaft. The length of the stroke of the main shaft is adjustable as are the force with which the anvil is struck along with the dwell time of the impact and the frequency with which impulses are applied to the armature of the linear motor. Adjustable periodic trains of impacts may be thus delivered so as to induce shock waves that will affect the musculature and bony structure within the body. Thus an operator can move vertebrae that are subluxations and can effect deep massage of muscle tissue.

It is thus an object of the present invention to provide a hand-held massage apparatus capable of providing a single impact of variable duration or dwell and also capable of providing multiple impacts of variable dwell and also of variable frequency.

It is a further object of the present invention to provide such an apparatus that will provide varying adjustable periodic impacts that will affect the musculature and bony structure within the body.

An additional object of the present invention is to provide adjustments of frequency and impact force such that a resonance condition can be set up in the body material so as to induce standing waves in the musculature and/or bony structure within the body.

It is an additional object of the present invention to provide a hand-held massage apparatus that is electronically controlled.

A further important object of the invention is to provide the hand-held massage apparatus such that minimal effort is required by an operator thus providing for increased operator ability to maintain an initially selected contact point.

Other objects and advantages of the invention will appear and be brought out more fully in the following specification, reference being had to the accompanying drawings wherein like reference numerals refer to like parts throughout and in which:

DRAWING SUMMARY

DETAILED DESCRIPTION

Figures 1, 2, 3:
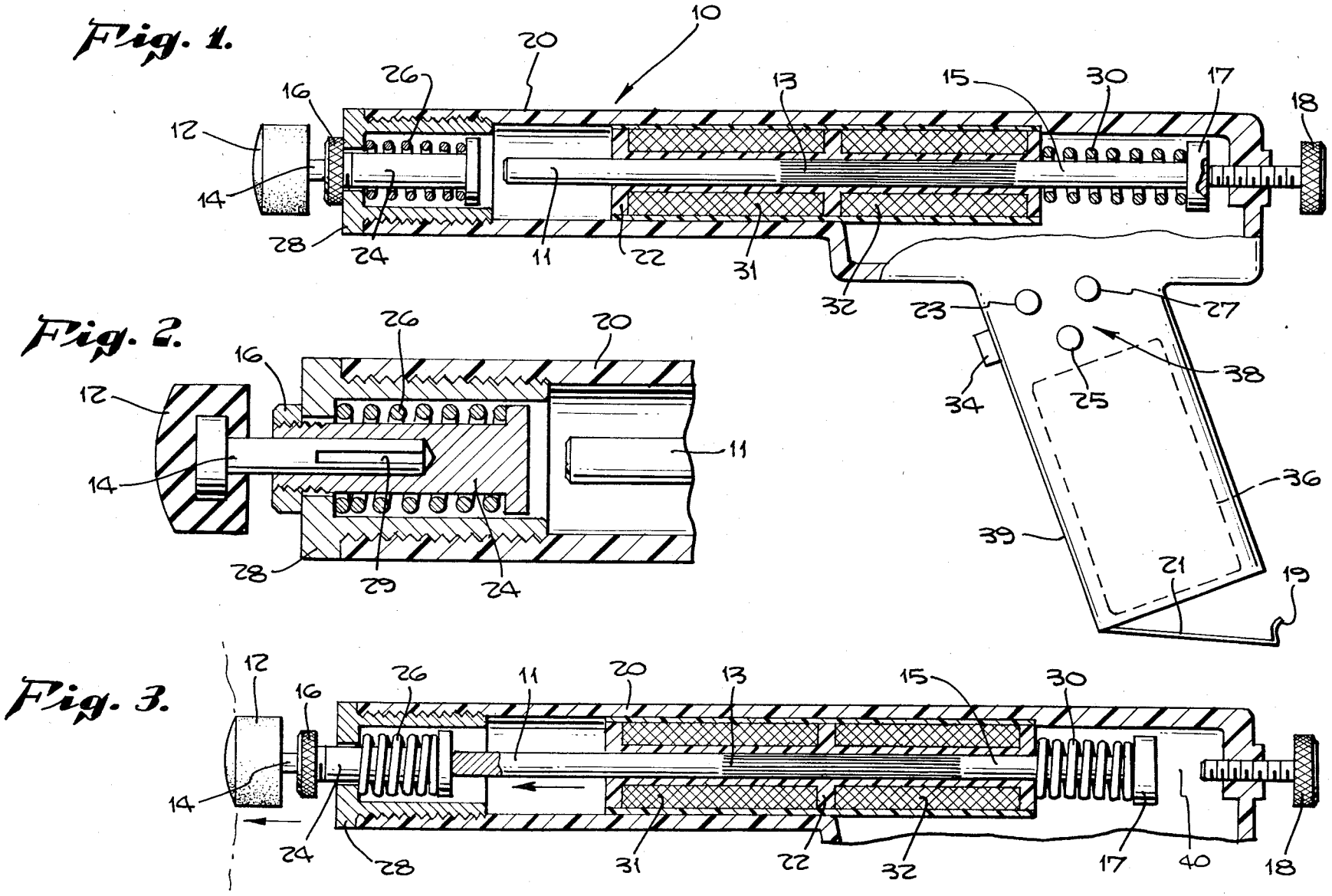
FIG. 1 is a partial cutaway side elevation showing moving parts of the apparatus in which the main shaft is shown retracted.
FIG. 2 is an enlargement of the front part of the apparatus.
FIG. 3 is a partial cutaway side elevation like FIG. 1, however, the main shaft is shown extended.

Referring to FIGS. 1, 2, and 3, in greater particularity there is shown a partial cutaway drawing of the device of the invention.

The general apparatus, denoted by the numeral 10, has a soft tip 12 supported on a soft tip shaft 14 that has a spring slot 29. Spring slot 29 provides relief for the friction fit of soft-tip shaft 14 into anvil 24. Anvil 24 is supported in housing 20 by the mechanical cooperation of retract spring 26, retract spring adjustment 28 and knurled shoulder nut return stop 16.

Nylon bobbin 22, having forward and rearward outer surface compartments, provides a winding support for solenoid coils 31 in its forward compartment and 32 in its rearward compartment and at the same time provides a hollow core for the main shaft comprising main shaft impact tip 11, main shaft cylindrical armature 13 and main shaft extension 15. With respect to main shaft cylindrical armature 13, at the distal end of main shaft extension 15 there is a main shaft head 17 which serves a dual purpose of retaining return spring 30 and cooperating with knurled stop adjustment screw 18 in effecting adjustment of the mechanical stroke adjustment gap 40. Main shaft cylindrical armature 13 is preferably fabricated from magnetic material such as soft iron while main shaft impact tip 11 and main shaft extension 15 are preferably fabricated from nonmagnetic materials such as brass or the like.

A power supply 36 may be located in the handle 39 and may be a battery pack either rechargeable and/or replaceable as is well known in the power supply art. Also contemplated as being situated in handle 39 is electronics package 38 along with controls therefor such as a pulse width control 23, frequency (period) control 25 and amplitude control 27, for example. The power supply 36 is retained in the handle 39 by means of access lid 21 and spring catch 19.

It should now be clear that the linear motor as contemplated by the present invention comprises a cylindrical armature responsive to magnetic forces induced by means of electric current flow in two separate solenoid coils in such a way as to be linearly driven in each of two directions such that one direction is linearly opposite to the other. The resulting motion is thus seen to be reciprocating motion.

Figure 5:
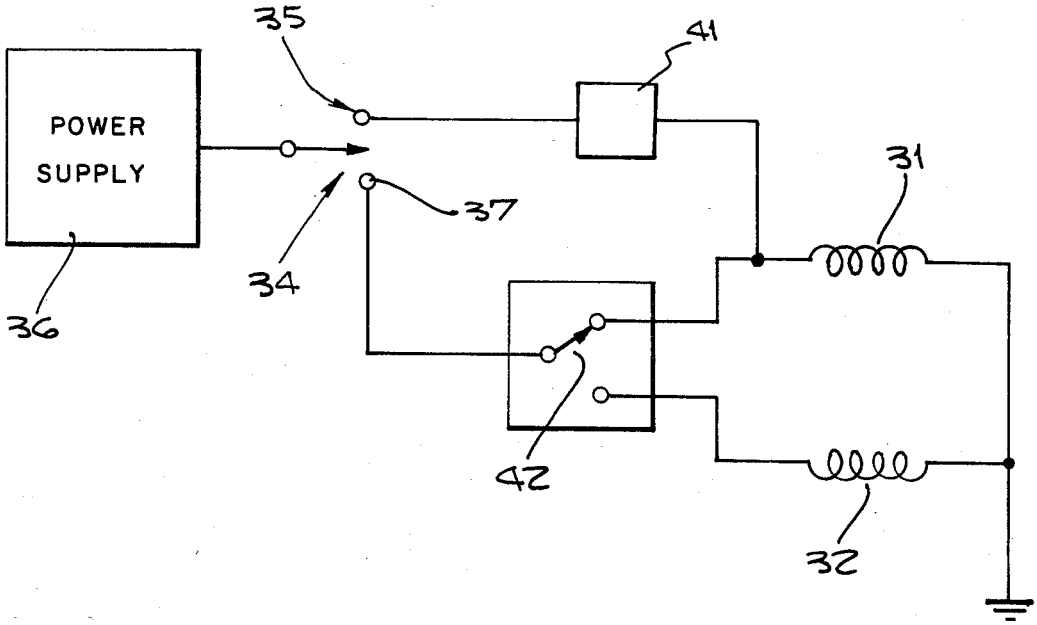
FIG. 5 is a partial block diagram of the electrical portion of the apparatus.

Referring now to FIG. 5, trigger switch 34 may be operated between two positions; 35, which may supply energizing current to a control 41 which may depend, for example, on a variable RC time constant circuit for the duration of its energized state, and 37, a contact which furnishes the energy of power supply 36 to transistor switch 42. The action of transistor switch 42 serves to furnish power supply voltage alternately to first solenoid coil 31 and then to second solenoid coil 32 for as long as trigger switch 34 is maintained in contact position 37.

Figure 4:
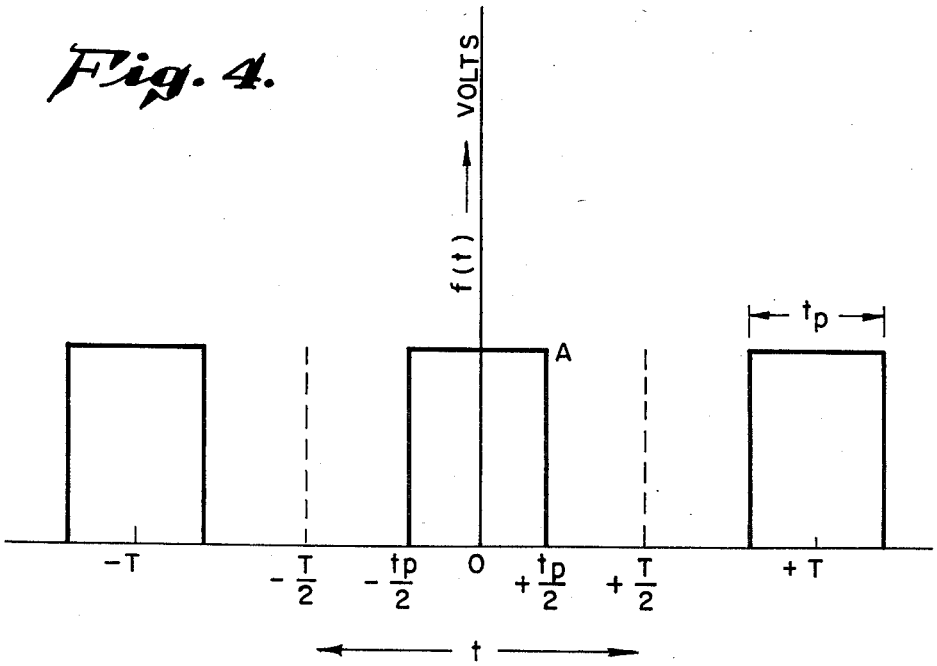
FIG. 4 shows a representative rectangular pulse train such as may be applied to the solenoid coils of the inventive device.

FIG. 4 illustrates a rectangular pulse train such as may be utilized to supply electric power to solenoid coils 31 and 32 on an alternate basis by means of the action of transistor switch 42. The energy pulse as shown has a pulse width or duration of $t_p$, a period T and an amplitude A which, at maximum, is equal to the voltage of the power supply 36. As is well known, the pulse train may be a function of the time, f(t) such that $$f(t) = A \text{ for } -tp/2 \infty t \leqq +tp/2$$

f(t)=0 elsewhere and also $f(t)=(nT+t)$ for integral n. It is contemplated that the controls 23, 25 and 27 will operate to adjust the parameters A=power supply voltage, $t_p$=pulse width and T=pulse period in a manner well known in the art of circuit design. Adjustment of control 23 thereby varying the pulse width $t_p$ will control the dwell time of the soft tip 12 in contact with the body of the recipient of the treatment. Adjustment of control 25 will control the period of the rectangular pulse train thus controlling the frequency of impact of the soft tip 12 upon the body of the recipient of the treatment, and adjustment of control 27 will control the force with which anvil 24 is struck by main shaft impact tip 11, thus controlling the force of impact of the soft tip 12 upon the body of the recipient of the treatment.

FIG. 1 shows the main shaft fully retracted within the constraints imposed such that the main shaft head 17 abuts knurled stop adjustment screw 18. This full retraction can be accomplished by the application of electric power to second solenoid coil 32 in cooperation with return spring 30. The spring constant of return spring 30 is chosen such that minimal interference with the electromagnetic forces applied by solenoid coils 31 and 32 is realized.

If now trigger switch 34 is operated to position 35 a single impulsive impact will be imparted to anvil 24 by mainshaft impact tip 11. In particular, first solenoid coil 31 will receive electric current from power supply 36 thus causing main shaft cylindrical armature 13 to drive toward a central position within the core of first solenoid coil 31 because of the electromagnetic action induced by the electric current. The driving force of main shaft cylindrical armature 13 toward a central position within first solenoid coil 31 will cause main shaft impact tip 11 to strike anvil 24 so as to drive it outward of the housing within the constraints imposed by retract spring adjustment 28 in cooperation with retract spring 26. FIG. 3 illustrates the resultant positions of the main shaft impact tip 11 in relation to anvil 24 and knurled shoulder nut return stop 16. Retract spring 26 and return spring 30 have both been compressed by this action and mechanical stroke adjustment gap 40 is clearly shown in this position. It is clear that soft tip 12 has been extended from its original position as shown in FIG. 1 such that an impact may have been imparted to a body for which treatment was intended. The duration time of the position assumed by soft tip 12 in imparting that impact may be controlled either manually as by maintaining trigger switch 34 in position 35 for a desired interval or the duration may be preselected, for example, through the operation of time delay circuits, the likes of which are well known in the art. Such a time delay circuit is contemplated as being adjustable so that the duration time may be varied as desired by the operator.

Operation of trigger switch 34 to position 37 causes electric current from power supply 36 to be applied to transistor switch 42 whose action is such that electric current is alternately applied to first and second solenoid coils 31 and 32 in a manner, for example, in accordance with the rectangular pulse train illustrated in FIG. 4. This means that if the first pulse on the left is applied to first solenoid coil 31, then the second pulse will be applied to second solenoid coil 32 and so on for as long as trigger switch 34 is maintained in position 37. Pulse amplitude A, may be controlled by manipulation of control 27. Circuit means for effecting such control are well known in the art. Pulse width, $t_p$, as controlling the dwell of soft tip 12 in an extended position, may be controlled by manipulation of control 23. Circuit means for effecting such control are also well known in the art. Also the period T and therefore the frequency of the pulses in the rectangular pulse train may be controlled by manipulation of control 25. Circuit means for effecting such control are well known in the art. It should be clear that control of the frequency of the rectangular pulse train acts to control the frequency of the impacts delivered to a body for which treatment is intended while control of the amplitude of the pulses in the rectangular pulse train will contribute to determination of the force of these impacts. The force of these impacts as delivered to a body under treatment is additionally contributed to by adjustments of knurled stop adjustment screw 18 which controls the dimension of mechanical stroke adjustment gap 40, and by knurled shoulder nut return stop 16 which limits the travel of soft tip 12 by controlling the travel of anvil 24.

Control of amplitude, frequency, and dwell of the periodic mechanical impacts thus delivered to the body of a workpiece, permit the timing of the impacts so provided in such a manner that successive impacts will reinforce each other and thus induce a state of resonance in such body material. This induced state of resonance may be manifested by standing waves set up in the body material, as is well known in the mechanical vibration arts.

While I have herein shown and described my invention in what I have conceived to be the most practical and preferred embodiments, it is pointed out that nevertheless, various changes and modifications, obvious to one skilled in the art to which the invention pertains are deemed to lie within the scope and purview of the invention.

What is claimed is:

1. Linear motor massage apparatus, comprising:

a housing having a handle;

an electronically controlled linear motor secured in said housing having an elongated cylindrical member comprising a central elongated cylindrical armature fabricated of magnetic metal abuttably joined at one end to an elongated cylindrical main shaft impact tip fabricated of non-magnetic metal of even cross section with said armature so as to be coaxial therewith, said armature joined at its other end to an elongated cylindrical main shaft extension also fabricated of non-magnetic metal and also of even cross section with said armature so as to be coaxial therewith, said extension being terminated at its end distal from said armature by a main shaft head;

a cylindrical nylon bobbin in said housing having a hollow core, a forward outer surface annular compartment and a rearward outer surface annular compartment, said elongated cylindrical member being slideably disposed in said hollow core;

two solenoid coils, a first one wound upon said forward outer surface annular compartment of said hollow cylindrical nylon bobbin and the other, a second solenoid coil, wound upon said rearward outer surface annular compartment of said nylon bobbin;

an anvil in said housing in coaxial alignment with said elongated cylindrical member and arranged so as to be struck at one end by said main shaft impact tip during operation of said linear motor;

means for supporting said anvil in said housing, comprising:

a retract spring adjustment member threadedly secured to said housing;

a retract spring resiliently retained between said spring adjustment member and said anvil;

a knurled shoulder nut return stop;

a soft tip shaft adapted by means of a spring slot to be frictionally retained in said anvil;

a return spring resiliently retained on said main shaft extension between one end of said bobbin and said main shaft head for retracting said elongated cylindrical member;

a knurled nut stop adjustment screw for adjusting the mechanical stroke of said elongated cylindrical member;

an electric power supply situated in said handle and adapted to supply operating power to said electronically controlled linear motor;

electronic control means comprising:

a trigger switch having at least two positions, a first one of which positions applies electric power from said electric power supply to said first solenoid coil for a preselected duration time;

an electronic control circuit to control said preselected duration time;

a second one of which positions of said trigger switch applies electric power from said electric power supply to an electronically controlled transistor switching circuit such that electric power is supplied alternately to said first solenoid coil and then to said second solenoid coil in the form of a continuous train of pulses;

means to control the amplitude of the train of electric pulses so applied;

means to control the frequency of said train of pulses so applied; and means to control the pulse width of said pulses in said train of pulses so applied.

2. The linear motor massage apparatus of claim 1 wherein said central elongated cylindrical armature is fabricated of soft iron.

3. The linear motor massage apparatus of claim 2 wherein said elongated cylindrical main shaft impact tip and said elongated cylindrical main shaft extension are both fabricated of brass.

* * * * *